US005271622A

United States Patent [19]

Rogerson

[11] Patent Number: 5,271,622

[45] Date of Patent: Dec. 21, 1993

[54] AERODYNAMIC GOLF CLUB HEAD

[75] Inventor: Zebulon W. Rogerson, Vienna, Va.

[73] Assignee: Zebulon Rogerson's Graphic Design, Washington, D.C.

[21] Appl. No.: 953,244

[22] Filed: Sep. 30, 1992

[51] Int. Cl.[5] ..... A63B 69/36; A63B 53/04

[52] U.S. Cl. ..... 273/186.2; 273/167 E; 273/174

[58] Field of Search ..... 273/194 A, 167 E, 173, 273/174, 186.2, 186.3, 187.4, 187.5, 164.1, 167 A

[56] References Cited

U.S. PATENT DOCUMENTS

| | | | |
|---|---|---|---|
| 1,336,671 | 4/1920 | Backus | 273/167 E |
| 1,549,350 | 8/1925 | Deike | 273/194 A X |
| 2,756,055 | 7/1956 | Bittner | 273/174 X |
| 3,794,328 | 2/1974 | Gordon | 273/167 E |
| 4,444,392 | 4/1984 | Duclos | 273/167 E X |
| 4,809,982 | 3/1989 | Kobayashi | 273/167 E |
| 4,850,593 | 7/1989 | Nelson | 273/167 E |
| 4,867,458 | 9/1989 | Sumikawa et al. | 273/171 |
| 4,900,029 | 2/1990 | Sinclair | 273/167 E |
| 5,050,879 | 9/1991 | Sun et al. | 273/171 X |

FOREIGN PATENT DOCUMENTS

| | | | |
|---|---|---|---|
| 233529 | 5/1925 | United Kingdom | 273/186.2 |

*Primary Examiner*—George J. Marlo
*Attorney, Agent, or Firm*—Ajay A. Jagtiani

[57] ABSTRACT

An aerodynamic golf club head is provided for increasing the speed of the head during a swing. The head comprises a head body having a face side for hitting the golf ball, a back side at an opposite side of the face side, a toe side connecting the face side to the back side, a heel side at an opposite side of the toe side, and an outer surface extending substantially between the face side and back side and formed by a sole side and a top surface. A substantially straight through hole formed in the head body is provided for allowing air to pass therethrough. The through hole has a first opening which opens in the sole side adjacent the striking face side and a second opening which opens in the top surface adjacent the back side.

20 Claims, 1 Drawing Sheet

FIG. 2
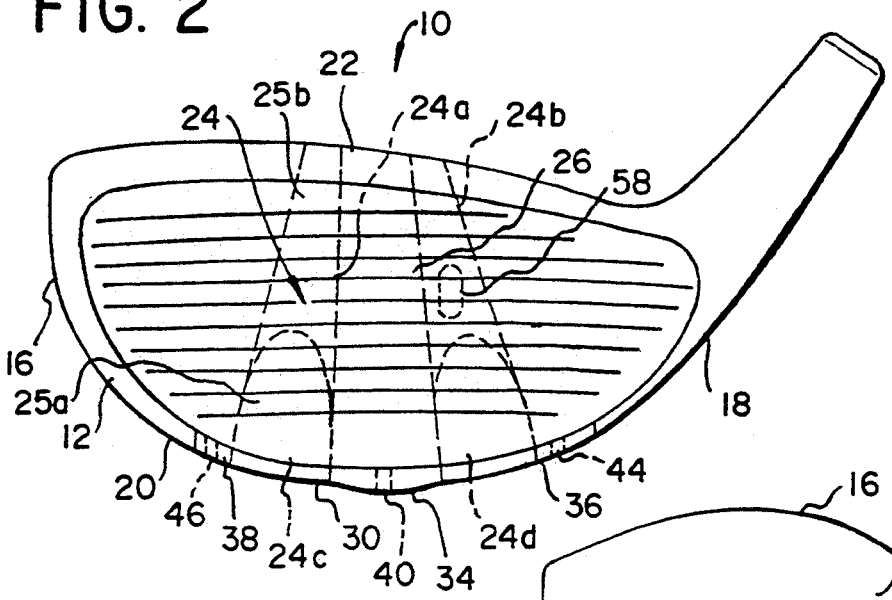
FIG. 3
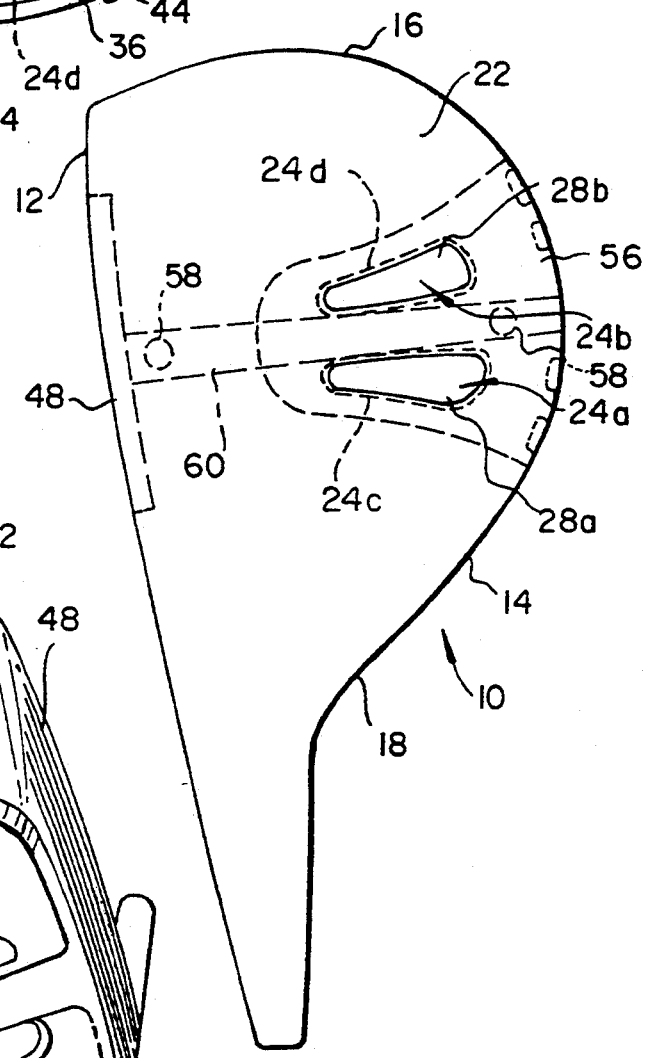
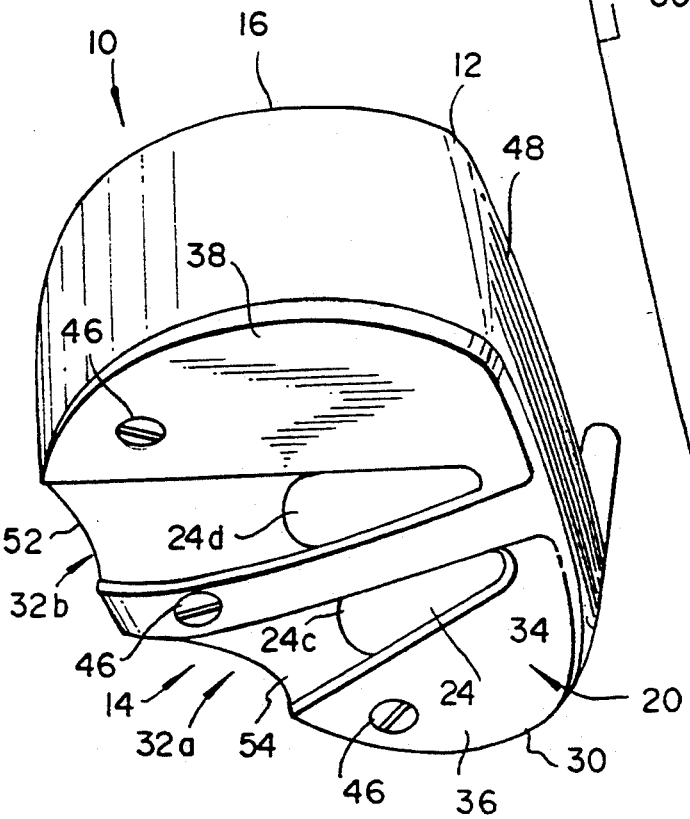
FIG. 1

AERODYNAMIC GOLF CLUB HEAD

FIELD OF THE INVENTION

This invention relates generally to golf club heads and, more particularly, to an aerodynamic golf club head for reducing the aerodynamic resistance acting upon the head during a swing.

BACKGROUND OF THE INVENTION

When a conventional golf club head is swung at an ordinary kinetic speed, an air flow boundary layer is produced on the outer surface of the head within a region between a face side and a back side of the head. The air flow boundary layer is exfoliated from the outer surface of the head, and thus a subatmospheric pressure region is created behind the head. Therefore, a turbulent air flow or swirling air stream is produced behind the head by the subatmospheric pressure.

In this air stream condition around the head, air in front of the head is compressed and the air pressure increased, but the air pressure behind the head is reduced. Accordingly, an aerodynamic drag due to the pressure difference in front of and behind the head is imposed on the head during the swing. It is known that such a pressure drag reduces the head speed during the swing, and thus reduces a distance of flight of a ball hit by the head. It is also known that such a pressure drag has an adverse effect on the stability of movement of the head during the swing, and thus causing a ball hit by the head to be sliced or hooked. Several attempts have been made to design golf club heads having improved aerodynamic performance. For example, U.S. Pat. No. 1,226,671 (Backus) discloses a golf putter having a plurality of holes in the face of the putter. The holes allow air to flow into a cavity located in the putter and out two venting holes, one on the top of the putter and one on the bottom.

U.S. Pat. No. 4,900,029 (Sinclair) discloses an aerodynamic shape for a golf club. The shape include a vertical airfoil and a cavity for directing air flow across the top of the club.

U.S. Pat. No. 3,794,328 (Gordon) discloses a plurality of passages extending from the face of a golf club to the rear of the club.

U.S. Pat. No. 4,444,392 (Duclos) discloses a club having an internal cavity which allows air to escape via a slot on the trailing edge of the club.

U.S. Pat. No. 4,809,982 (Kobayashi) discloses a golf club head having an air passage form the leading edge to the trailing edge of the golf club. This passage is at an angle to the base of the club.

U.S. Pat. No. 4,850,593 (Nelson) discloses an aerodynamic head having a sculptured top and a v shaped groove at the base of club head.

In an attempt to reduce the likelihood of slicing or hooking a golf ball, perimeter weighting has been provided in golf club heads. For example, U.S. Pat. No. 4,867,458 (Sumikawa et al.) discloses the use of screws as perimeter weights for a golf club.

U.S. Pat. No. 5,050,879 (Sun et al.) discloses the use of metal inserts for changing the weight characteristics of a golf club.

SUMMARY OF THE INVENTION

According to the invention, an aerodynamic golf club head is provided which has the advantage of having an increased head speed while also reducing the possibility of slicing or hooking a golf ball. According to a preferred embodiment of the invention, the aerodynamic golf club head comprises a head body having a face side for hitting the golf ball, a back side at an opposite side of the face side, a toe side connecting the face side to the back side, a heel side at an opposite side of the toe side, and an outer surface extending substantially between the face side and back side and formed by a sole side and a top surface. A substantially straight through hole formed in the head body is provided for allowing air to pass therethrough. The through hole has a first opening which opens in the sole side and a second opening which opens in the top surface. Thus, air flows from the sole side to the top surface.

Optionally, a whistling device is provided. This whistling device is inserted in or in the vicinity of the through holes and generates a whistle at a particular frequency when the golf club is swung. When a golfer swings the club and attached head faster, the frequency of the whistle increases. Thus, a golfer may determine the speed of the club just by listening to the frequency of the whistle.

Other features and advantages of the invention will be set forth in, or apparent from, the following detailed description of the preferred embodiment of the invention.

BRIEF DESCRIPTION OF THE DRAWINGS

FIG. 1 is a perspective view of an aerodynamic golf club head constructed in accordance with a preferred embodiment of the invention;

FIG. 2 is a side elevational view of FIG. 1; and

FIG. 3 is a plan view of FIG. 1.

DESCRIPTION OF THE PREFERRED EMBODIMENTS

Referring to the Figures, an aerodynamic golf club head, generally denoted 10, constructed in accordance with a preferred embodiment of the invention is shown. Golf Club head 10 is formed from a body having a face side 12 for hitting the golf ball, a back side 14 at an opposite side of the face side 12, a toe side 16 connecting the face side 12 to the back side 14, a heel side 18 at an opposite side of the toe side 16, and an outer surface extending substantially between the face side 12 and back side 14 and formed by a sole side 20 and a top surface 22. The head 10 is constructed from wood, graphite, steel, stainless steel, synthetic resins, aluminum, copper alloy, ceramic, or a combination of the above or any other construction material known in the golfing art.

A substantially straight through hole 24 is formed in head 10 for allowing air to pass therethrough. The through hole 24 has a first set of openings **24*a* and 24*b* which open in the top surface 22 and a second set of opening 24*c* and 24*d* which open in the sole side 20. Through hole 24 is placed primarily to promote perimeter weighting of the club mass and provide for the aerodynamic channeling of air therethrough. The through hole 24 should be centered from the heel 18 to toe 16 and should be angled from a lower portion of the face side 12 upward to the rearmost portion of top surface 22. In a preferred embodiment, through hole 24 provides a generally conical cavity and is formed by a first region 25*a* which may be described as a quadric, i.e., a surface whose equation in cartesian or homogeneous coordinates is of the second degree such as a conicoid, spheroid, ellipsoid, paraboloid, hyperboloid, or a communication with region 25***a* and having the shape of a truncated cone. It should be noted that any shape for through hole 24 may be employed but that the above described conical cavity formed by through hole 24 provides the maximum aerodynamic effect. Openings 24*a* and 24*b* have a substantially elliptical shape and are disposed symmetrically about a centerline extending from the face side 12 to the back side 14. These openings 24*a* and 24*b* have outwardly facing flares 28*a* and 28*b* facing the heel and toe sides, respectively. In operation, air flows into openings 24*c* and 24*d* through hole 24 and exits through openings 24*a* and 24*b*.

A sole plate 30 is mounted upon sole side 20. The thickness of the sole plate 30 varys from the face side 12 to the back side 14. Sole plate 30 has two v shaped flutes 32*a* and 32*b* which are disposed symmetrically about a centerline extending from the back side 14 to the face side 12. The v shaped flutes 32*a* and 32*b* taper inwardly from the back side 14 to the face side 12 and thus form a center rail 34 extending along the center line and disposed between the v shaped flutes 32*a* and 32*b* as well as forming two semi-elliptical regions 36 and 38. The semi-elliptical regions 36 and 38 are each disposed outwardly from their respective v shaped flutes 32*a* and 32*b*. In a preferred embodiment, center rail 34 is thicker than either of the semi-elliptical regions 36 and 38. Openings 24*c* and 24*d* have a substantially teardrop shape and are disposed above v shaped flutes 32*a* and 32*b*, respectively. Additionally, a support member 60 which extends between the face side 12 and back side 14 may be provided to increase the structural integrity of golf club head 10.

A group of ports comprising, a first port 40 disposed in the center rail 34, a second port 44 and third port 46 disposed in a respective semi-elliptical regions 36 and 38, are provided for allowing the insertion of respective perimeter weights 46 therein. This ability to insert different perimeter weights 46 into head 10 allows a golfer the option of custom tailoring their club to prevent slicing or hooking. Head 10 is provided with a face insert 48 which provides a hard surface for a golf ball to strike. As may be seen in FIG. 3, the insert is countersunk or applied to entire face side 12 of head 10 so as to be flush with the face side 12. A hosel 50 is provided for mounting the head 10 to a golf club shaft (not shown).

As may be seen in FIGS. 1 and 3, contoured surfaces may be incorporated into the design of the golf club head 10. For example, sole side 20 is provided with two concave surfaces or scallops 52 and 54 which are disposed in cooperation with v shaped flutes 32*a* and 32*b* as well as 24*c* and 24*d*. Additionally, a concave surface 56 may be provided in top surface 22 as illustrated in FIG. 3. The aerodynamic effect of these contoured surfaces is disclosed in U.S. Pat. No. 4,850,539 (Nelson) which is hereby incorporated by reference.

An optional whistling member 58 may be inserted in, see FIG. 2, or in the vicinity of hole 24, see FIG. 3, so that when a golfer swings head 10, a sound at a particular frequency is generated. By listening to the frequency of the sound, the golfer will be able to tell how fast the head 10 was swung, i.e. frequency will increase with speed. Whistling member may be formed from a reed or similar device or may be formed by the combination of hole 24 and contoured surfaces 52, 54 and 56.

Although the present invention has been described relative to specific exemplary embodiments thereof, it will be understood by those skilled in the art that variations and modifications can be effected in these exemplary embodiments without departing from the scope and spirit of the invention.

What is claimed is:

1. An aerodynamic golf club head for hitting a golf ball, said head comprising:

a head body having a solid face side for hitting said golf ball, a back side at an opposite side of said face side, a toe side connecting said face side to said back side, a heel side at an opposite side of said toe side, and an outer surface extending substantially between said face side and back side and formed by a sole side and a top surface, said head body having a substantially straight through hole formed therein for allowing air to pass therethrough, said through hole having a first opening which opens in said top surface adjacent said back side and a second opening which opens in said sole side adjacent said solid face side, said openings for allowing air to enter one of said openings and exit the other one of said openings and thereby improving the aerodynamic efficiency of said club.

2. The head recited in claim 1 further comprising a sole plate attached to said sole side.

3. The head recited in claim 2 wherein a thickness of said sole plate decreases from said face side to said back side.

4. The head recited in claim 2 wherein said sole plate has two v shaped flutes disposed symmetrically about a centerline extending from said back side to said face side, said v shaped flutes tapering inwardly from said back side to said face side, said v shaped flutes thus forming a center rail extending along said center line and disposed between said v shaped flutes and also forming two semi-elliptical regions, each disposed outwardly from a respective v shaped flute.

5. The head recited in claim 4 further comprising at least a first port in said center rail, said port for allowing insertion of a perimeter weight therein.

6. The head recited in claim 4 further comprising a second and third port one disposed in each respective semi-elliptical regions, said ports for allowing insertion of respective perimeter weights therein.

7. The head recited in claim 4 further comprising a first port disposed in said center rail, a second and third port, each disposed in a respective semi-elliptical region, said ports for allowing insertion of respective perimeter weights therein.

8. The head recited in claim 4 wherein said center rail is thicker than said semi-elliptical regions.

9. The head recited in claim 1 further comprising a face insert disposed in said solid face side for providing a hard surface for said golf ball to strike.

10. The head recited in claim 1 wherein said through hole has an inner surface having a shape which is defined by a quadric, said quadric shape for moving a center of mass of said head towards said back side of said head.

11. The head recited in claim 1 further comprising a third opening which opens in said top surface and a fourth opening which opens in said sole side.

12. The head recited in claim 11 wherein said first and third openings have a substantially elliptical shape and are disposed symmetrically about a centerline extending from said face side to said back side, said openings flaring outwardly from said face side to said back side.

13. The head recited in claim 1 wherein said head is constructed from a material selected from the group consisting of wood, graphite, steel, stainless steel, aluminum, copper alloy, ceramic and synthetic resins.

14. The head recited in claim 1 further comprising a means for generating a whistle of a particular frequency which is representative of speed of said golf club head.

15. An aerodynamic golf club head for hitting a golf ball, said head comprising:

a head body having a solid face side for hitting said golf ball, a back side at an opposite side of said face side, a toe side connecting said face side to said back side, a heal side at an opposite side to said toe side, and an outer surface extending substantially between said face side and back side and formed by a sole side and a top surface, said head body having a substantially straight through hole formed therein for allowing air to pass therethrough, said through hole having a first opening which opens in said top surface adjacent said back side, a second opening which opens in said sole side, a third opening which opens in said top surface and a fourth opening which opens in said sold side adjacent said solid face side; and a sole plate mounted to said sole side and having two v shaped flutes disposed symmetrically about a centerline extending from said back side to said face side, said v shaped flutes tapering inwardly from said back side to said face side, said v shaped flutes thus forming a center rail extending along said center line and disposed between said v shaped flutes and also forming two semi-elliptical regions, each disposed outwardly from a respective v shaped flute.

16. The head recited in claim 15 further comprising a means for generating a whistle of a particular frequency which is representative of speed of said golf club head.

17. The head recited in claim 15 further comprising a first port disposed in said center rail, a second and third port, each disposed in a respective semi-elliptical region, said ports for allowing insertion of respective perimeter weights therein.

18. The head recited in claim 15 further comprising a face insert disposed in said solid face side for providing a hard surface for said ball to strike.

19. The head recited in claim 15 wherein said first and third openings have substantially elliptical shape and are disposed symmetrically about a centerline extending from said face side to said back side, said first and third openings flaring outwardly from said face side to said back side; and wherein said second and fourth openings are disposed in cooperation with said v shaped flutes respectively.

20. An aerodynamic head of a golf club for hitting a golf ball, said head comprising:

a head body having a face side for hitting said golf ball, a back side at an opposite side of said face side, a toe side connecting said face side to said back side, a heal side at an opposite side of said toe side, and an outer surface extending substantially between said face and back side and formed by a sole side and a top surface, said head body having a substantially straight through hole formed therein for allowing air to pass therethrough, said through hole having a first opening which opens in said top surface, a second opening which opens in said sole side, a third opening which opens in said top surface and a fourth opening which opens in said sole side;

a sole plate mounted to said sole side and having two v shaped flutes disposed symmetrically about a centerline extending from said back side to said face side, and v shaped flutes tapering inwardly from said back side to said face side, said v shaped flutes thus forming a center rail extending along said center line and disposed between said v shaped flutes and also forming two semi-elliptical regions, each disposed outwardly from a respective v shaped flute, and wherein said first and third openings have a substantially elliptical shape and are disposed symmetrically about a centerline extending from said face side to said back side, said first and third openings flaring outwardly from said face side to said back side; and wherein said second and fourth openings are disposed in said v shaped flutes respectively;

a first port disposed in said center rail, a second and third port, each disposed in said respective semi-elliptical region, said ports for allowing insertion of respective perimeter weights therein; and a means for generating a whistle of a particular frequency which is representative of speed of said golf club head.

* * * * *